US007549787B1

(12) United States Patent
Blaymore

(10) Patent No.: US 7,549,787 B1
(45) Date of Patent: Jun. 23, 2009

(54) PIVOTING LOCK MECHANISM FOR FLUORESCENT LAMP SOCKETS

(76) Inventor: Lee Blaymore, 3550 Woodward St., Oceanside, NY (US) 11572-4531

( * ) Notice: Subject to any disclaimer, the term of this patent is extended or adjusted under 35 U.S.C. 154(b) by 0 days.

(21) Appl. No.: 12/060,770

(22) Filed: Apr. 1, 2008

(51) Int. Cl.
*F21V 19/00* (2006.01)

(52) U.S. Cl. ..... 362/655; 362/647; 362/219; 439/232; 439/233; 439/238; 439/240

(58) Field of Classification Search ..... 362/260, 362/219, 225, 647, 640, 655, 656, 457; 439/226, 439/232, 233, 237, 238, 239, 240
See application file for complete search history.

(56) References Cited

U.S. PATENT DOCUMENTS

| | | | | |
|---|---|---|---|---|
| 2,424,874 | A * | 7/1947 | Beals | 439/232 |
| 3,654,587 | A | 4/1972 | McLaughlin | |
| 3,892,457 | A * | 7/1975 | Detch et al. | 439/233 |
| 3,909,100 | A | 9/1975 | Hodge, Jr. | |
| 4,306,758 | A * | 12/1981 | Johnson et al. | 439/232 |
| 5,442,141 | A | 8/1995 | Gretz | |
| 5,542,850 | A | 8/1996 | Frantz | |
| 5,904,415 | A | 5/1999 | Robertson et al. | |
| 5,931,691 | A | 8/1999 | Mews et al. | |
| 6,109,975 | A | 8/2000 | Nitta | |
| 6,190,200 | B1 | 2/2001 | Burwell | |
| 6,231,373 | B1 | 5/2001 | Daoud | |
| 6,769,789 | B1 * | 8/2004 | Won et al. | 362/260 |
| 7,052,171 | B1 | 5/2006 | Lefebvre et al. | |

FOREIGN PATENT DOCUMENTS

| | | |
|---|---|---|
| FR | 2.573.578 | 5/1986 |
| GB | 222.611 | 10/1924 |
| GB | 479.709 | 2/1938 |
| GB | 1.142.844 | 2/1969 |
| JP | 2312175 | 12/1990 |
| JP | 2006120428 | 5/2006 |

* cited by examiner

*Primary Examiner*—Laura Tso
(74) *Attorney, Agent, or Firm*—Michael I Kroll

(57) ABSTRACT

A fluorescent tube lamp socket having a housing with opposing sided electrical contacts with one of the contacts and housing portion pivotal relative to the other to allow for increased access and easier placement of a lamp therein. The bulb socket housing having a cavity providing for pivotal movement during lamp insertion that once placed therein is pivotal to a seated locked position ensuring contact between the bulb pins and socket electrical contacts.

10 Claims, 8 Drawing Sheets

PIVOTING LOCK MECHANISM FOR FLUORESCENT LAMP SOCKETS

BACKGROUND OF THE INVENTION

1. Field of the Invention

Figure 1:
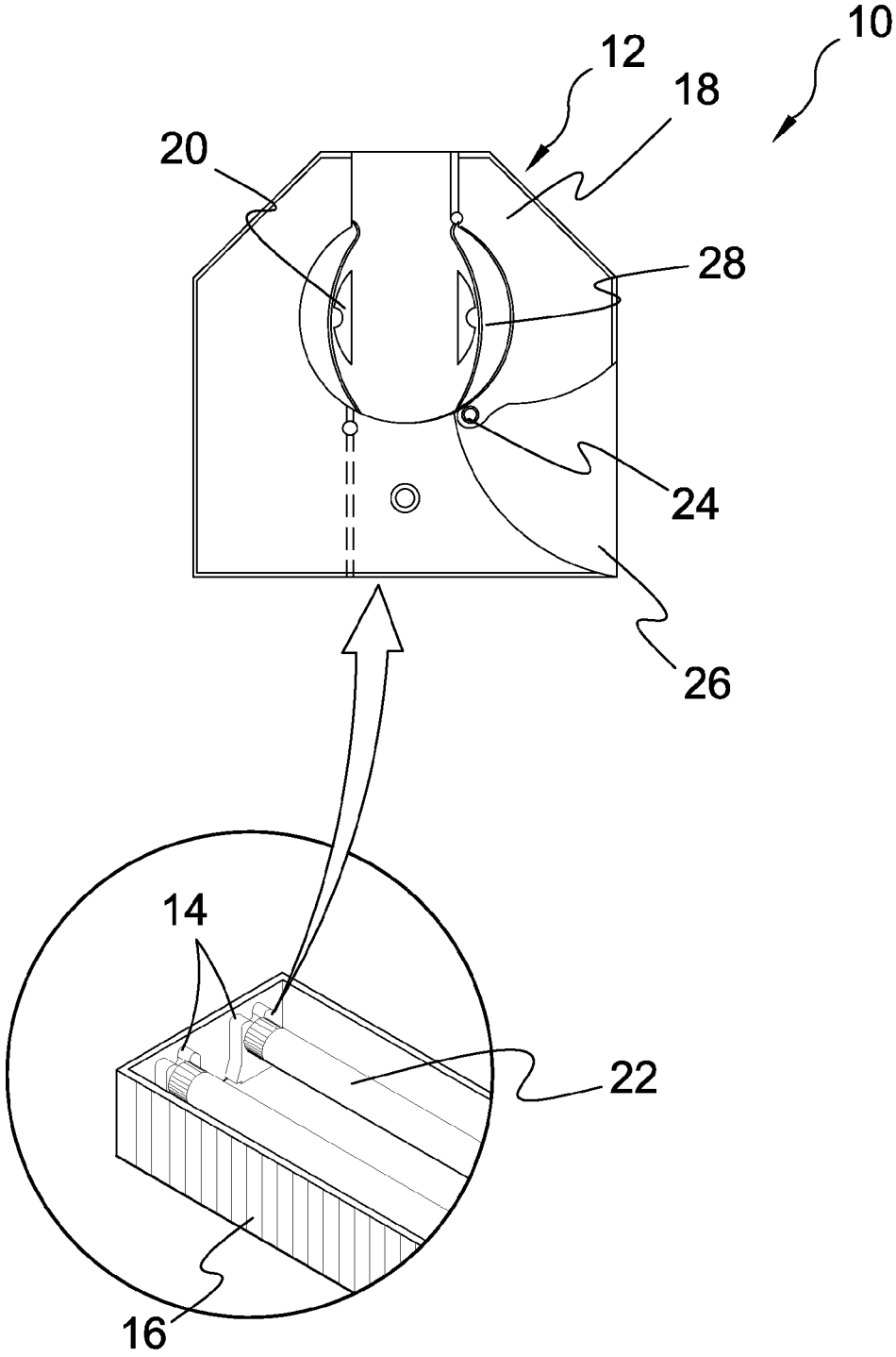

The present invention relates generally to light bulb sockets and, more specifically, to a fluorescent bulb socket having a housing with opposing sided electrical contacts with one of the contacts and housing portions having a pivotal locking mechanism relative to the other whereby the user may completely open the socket. The bulb socket housing has a cavity providing for pivotal movement during bulb insertion that once placed therein is pivotal to a seated locked position ensuring contact between the bulb pins and sockets electrical contacts once the bulb has been correctly and easily placed.

2. Description of the Prior Art

There are other fluorescent bulb sockets designed for the same purpose. Typical of these is U.S. Pat. No. 3,654,587 issued to McLaughlin on 4, Apr. 1972.

Another patent was issued to Hodge Jr. on 30, Sep. 1975 as U.S. Pat. No. 3,909,100. Yet another U.S. Pat. No. 5,442,141 was issued to Gretz on 15, Aug. 1995 and still yet another was issued on 18, May 1999 to Robertson et al. as U.S. Pat. No. 5,904,415.

Another patent was issued to Mews et al. on 3, Aug. 1999 as U.S. Pat. No. 5,931,691. Yet another U.S. Pat. No. 6,109,975 was issued to Nitta on 29, Aug. 2000. Another was issued to Burwell on 20, Feb. 2001 as U.S. Pat. No. 6,190,200 and still yet another was issued on 15, May 2001 to Daoud as U.S. Pat. No. 6,321,373.

Another patent was issued to Lefebvre et al. on 30, May 2006 as U.S. Pat. No. 7,052,171. Yet another UK Patent No. 222,611 was issued to Lee et al. on 9 Oct. 1924. Another was issued to Vendope et al. on 10, Feb. 1938 as UK Patent No. 479,709 and still yet another was issued on 12 Feb. 1969 to Linolite Limited et al. as UK Patent No. 1,142,844.

Another patent was issued to Bourron on 23, May 1986 as FR. Patent No. FR2573578. Yet another JP Patent No. JP2312175 was issued to jiyon et al. on 27, Dec. 1990.

U.S. Pat. No. 3,654,587

Inventor: Emmett McLaughlin

Issued: Apr. 4, 1972

Contact members within a housing of a fluorescent lamp holder are provided with a mounting portion secured in fixed position between the front and back members of the housing and a pin-contacting portion that is flat and parallel with a housing wall and not subject to twisting, the pin-contacting portion extending across a frontal opening for engaging an inserted lamp pin. The contact member has resilient means for permitting lateral motion parallel to the front wall but is constrained from any appreciable motion perpendicular to the front wall.

U.S. Pat. No. 3,909,100

Inventor: Thomas Hodge Jr.

Issued: 30, Sep. 1975

A mounting arrangement for a cylindrical lamp, such as a fluorescent lamp, comprises a pair of spaced apart sockets for engaging opposite ends of the lamp so that an electrical connection is made with the lamp. At least one of the sockets is movable toward and away from the other socket and is mounted in a bracket, at least a portion of which is also movable toward and away from the other socket. A spring provides a biasing action axially of the lamp to maintain a secure engagement of the lamp by the sockets. When the lamp is disposed between the sockets so as to be engaged thereby, movement of the movable portion of the bracket toward the other socket and into a predetermined locking position tends to compress the spring so as to maintain engagement of the lamp by the sockets. Movement of the movable portion of the bracket away from the other socket and away from the predetermined locking position, when the lamp is engaged by the sockets, tends to release compression on the spring and permits movement of the movable socket away from the other socket. The lamp can then be disengaged from the sockets and axially displaced from between the sockets.

U.S. Pat. No. 5,442,141

Inventor: Thomas Gretz

Issued: 15, Aug. 1995

This invention relates to electrical connectors, specifically to an electrical connector that is easy to insert into a hole or knock-out of an electrical junction box. Design of the connector provides for positive fixture of the connector in the box once non-metallic sheathed cable, either oval or circular in cross-directional shape, is inserted through the connector, thus preventing the cable from being withdrawn. The C-shaped one piece connector of this disclosure contains an integral hinge, a cutout area, and a necked down area on the top flange to provide for easy flexing about the central insertion axis and therefore easy insertion into an electrical junction box. The jaws of the electrical connector are designed such that a positive bite or grip is applied to an oval or circular non-metallic sheathed cable as tension is applied on said cable to attempt to remove it from said electrical enclosure.

U.S. Pat. No. 5,904,415

Inventor: Roger Robertson et al.

Issued: 18, May 1999

A connector is provided for securing a fluorescent light bulb having a given length into a lighting fixture having spaced apart bulb-receiving members, with the space between the bulb-receiving members being longer than the length of the bulb. The connector also has fluorescent bulb pin openings at one end which receive a lighting bulb pin or pins at one end and connector pins at the other end of the connector for receipt within a companion opening or slots within the bulb-receiving members of the lighting fixture.

U.S. Pat. No. 5,931,691

Inventor: Hans Peter Mews et al.

Issued: 3, Aug. 1999

An easily assembled socket, particularly for elongated lamps such as fluorescent lamps for use with, or without associated starters, which can be wired by automatic wiring machinery. A socket housing (2) of insulating material has reception chambers (33, 48) for receiving the blade part (57)

of an slit blade insulation piercing (SBIP) connector portion (53) of a contact spring (49). The connector portion (53) extends to a connecting element portion (52) which, in turn, terminates in a contact terminal end portion (51) for engagement with a projecting terminal pin of the electrical device. The contact spring (49) is a unitary element, which can be slipped into the reception chamber (33, 48) via a lateral opening (44). Wire positioning recesses (24, 25, 34, 35) are formed in the housing leading to and from the chambers (33, 48). The blade part (57) of the connector (53) engages on the bottom wall (16) of the housing so that insertion pressure, upon insertion of a wire (W), is directly transferred to the housing structure. The housing can have a lateral extension to receive a starter, with one contact spring bent to engage the starter terminals; or a starter housing can be formed separately, supplied with SBIP connectors. If the material of the housing is flexible, it can be formed with a living hinge (103), the contact springs (49c) being inserted flat into the respective chambers and the assembly then bent about an axis transverse to the plane of the contact springs.

U.S. Pat. No. 6,109,975

Inventor: Kazuto Nitta

Issued: 29, Aug. 2000

An electric connector comprises: electric terminals; and a connector housing formed from an insulating member. The connector housing comprises, a body portion having a pipe-like shape with base-end opening portions to which the electric terminals are inserted, a cover portion for covering the base-end opening portions of the body portion, and hinge portions connecting the body portion with the cover portion and being deformable to bend to make the cover portion cover the body portion.

U.S. Pat. No. 6,190,200

Inventor: John Burwell

Issued: 20, Feb. 2001

Apparatus and method for providing simple and effective attachment of a lamp holder base to a mounting plate includes providing in the mounting plate an opening having a wide opening portion and a relatively narrower opening portion, which together define at least one mounting tab of the mounting plate, the mounting plate further having an outer surface and a latch edge portion; providing on the lamp holder base an elongated body and a latch member, the elongated body including at least one mounting channel having a base surface and an inclined surface which define a first channel opening and a second channel opening, the inclined surface terminating at the first channel opening to define a pivot edge, the latch member including a latch surface region; inserting the elongated body in the wide opening portion until a cross section of the mounting plate is generally aligned with one of the first channel opening and the second channel opening; moving the mounting plate in a direction such that the at least one mounting tab engages the at least one mounting channel; aligning generally the latch member with the latch edge portion of the mounting plate; and rotating the mounting plate about the pivot edge until the latch surface region engages a portion of the outer surface of the mounting plate.

U.S. Pat. No. 6,231,373

Inventor: Bassel Daoud

Issued: 15, May 2001

A latching mechanism for an insulation displacement connector comprises a cap section, a base section, a latch member and a biasing member preferably configured as a type of spring. The cap section is movable between an open position and a closed position and includes a finger-grip member. The base section is connected to the cap section and includes a latch retaining portion. The latch member contains a latch-engaging portion, a living hinge and a latch base. The latch member is movable between an engaged position and disengaged position. The latch member maintains the cap section in the closed position when the latch member is in the engaged position and the latch engaging portion is confrontingly engaged with the latch retaining portion in this closed position. The biasing member may be formed as an elastically deformable member that has a bend point and is connected to the cap section proximate the finger grip member. Additionally, the biasing member is connected to the latch member at the latch base. The biasing member is forced to bend at the bend point by the latch member when the latch member pivots about the living hinge as it is moved to the disengaged position. This tensions the biasing member causing it to exert an opposing force on the latch member, biasing it so that it tends to return it to the engaged position.

U.S. Pat. No. 7,052,171

Inventor: Phillip Lefebvre et al.

Issued: 30, May 2006

A lighting assembly has an elongated housing which contains a plurality of light emitting diodes that send light from one side of the housing. Connectors at the ends of the housing are provided to connect the lighting assembly into standard sockets of a fluorescent light fixture that has been modified to power the light emitting diodes. At least one of the connectors has a releasable holding mechanism that allows the housing to be rotated with respect to the sockets to aim the light is a desired direction and then hold the housing in that orientation.

UK Patent Number GB222,611

Inventor: Donald Hunter Lee et al.

Issued: 9, Oct. 1924

An improved electric lamp securing clip for use with holders carrying shades characterized by a hinged bracelet or clip having a base flange to engage the lower edge of the lamp holder, said flange carrying one or two interior projections adapted to enter and obstruct the vertical slots below the lamp pins and apertures such as in the clips to receive the lamp pins, the clip being provided with a suitable lock, substantially as described.

UK Patent Number GB479,709

Inventor: Van Lawrence Vendope

Issued: 10, Feb. 1938

A supporting and electric conducting bracket for an elongated lamp comprising bars of electric conductivity having each one end electrically connected to the end of the lamp and having at the opposite end means for attachment to an electric outlet terminal, whereby the bars, and hence the lamp are solely supported from said outlet terminal upon the attachment of said means.

UK Patent Number GB 1,142,844

Inventor: Linolite Limited et al.

Issued: 12, Feb. 1969

A lamp holder for double ended electric lamp tubes comprising a switch positioned to make or break the electric circuit between the contact of at least one socket and the mains connection, the switch being operated by an element so positioned and arranged that it is moved against a bias to position a switch contact in an "operative position" on introduction of a lamp tube into its correct position in the holder and is moved by biasing means to position the switch contact in an inoperative position when the lamp tube is displaced from its correct position.

While these light sockets may be suitable for the purposes for which they were designed, they would not be as suitable for the purposes of the present invention, as hereinafter described. The present invention provides a fluorescent bulb socket having housing with opposing sided electrical contacts with one of the contacts and housing portion pivotal relative to the other. The bulb socket housing has a cavity providing for pivotal movement during bulb insertion that once placed therein is pivotal to a seated locked position ensuring contact between the bulb pins and socket electrical contacts.

SUMMARY OF THE PRESENT INVENTION

A primary object of the present invention is to provide a fluorescent bulb socket having a housing with opposing sided electrical contacts, whereby on side may be opened in pivotal relation to the other side Another object of the present invention is to provide a fluorescent bulb socket having a housing with opposing sided electrical contacts with one of the contacts and housing portions being in pivotal relation to the other to allow for easy access and placement of a bulb into the socket.

Yet another object of the present invention is to provide a bulb socket housing having a cavity providing for pivotal movement during bulb insertion that once placed therein is pivotal to a seated locked position ensuring contact between the bulb pins and socket electrical contacts.

Additional objects of the present invention will appear as the description proceeds.

The present invention overcomes the shortcomings of the prior art by providing a fluorescent bulb socket having a housing with opposing sided electrical contacts with one of the contacts and housing portion pivotal relative to the other to allow for increased access and easier placement of a bulb. The bulb socket housing having a cavity providing for pivotal movement during bulb insertion that once placed therein is pivotal to a seated locked position ensuring contact between the bulb pins and socket electrical contacts.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Figure 2:
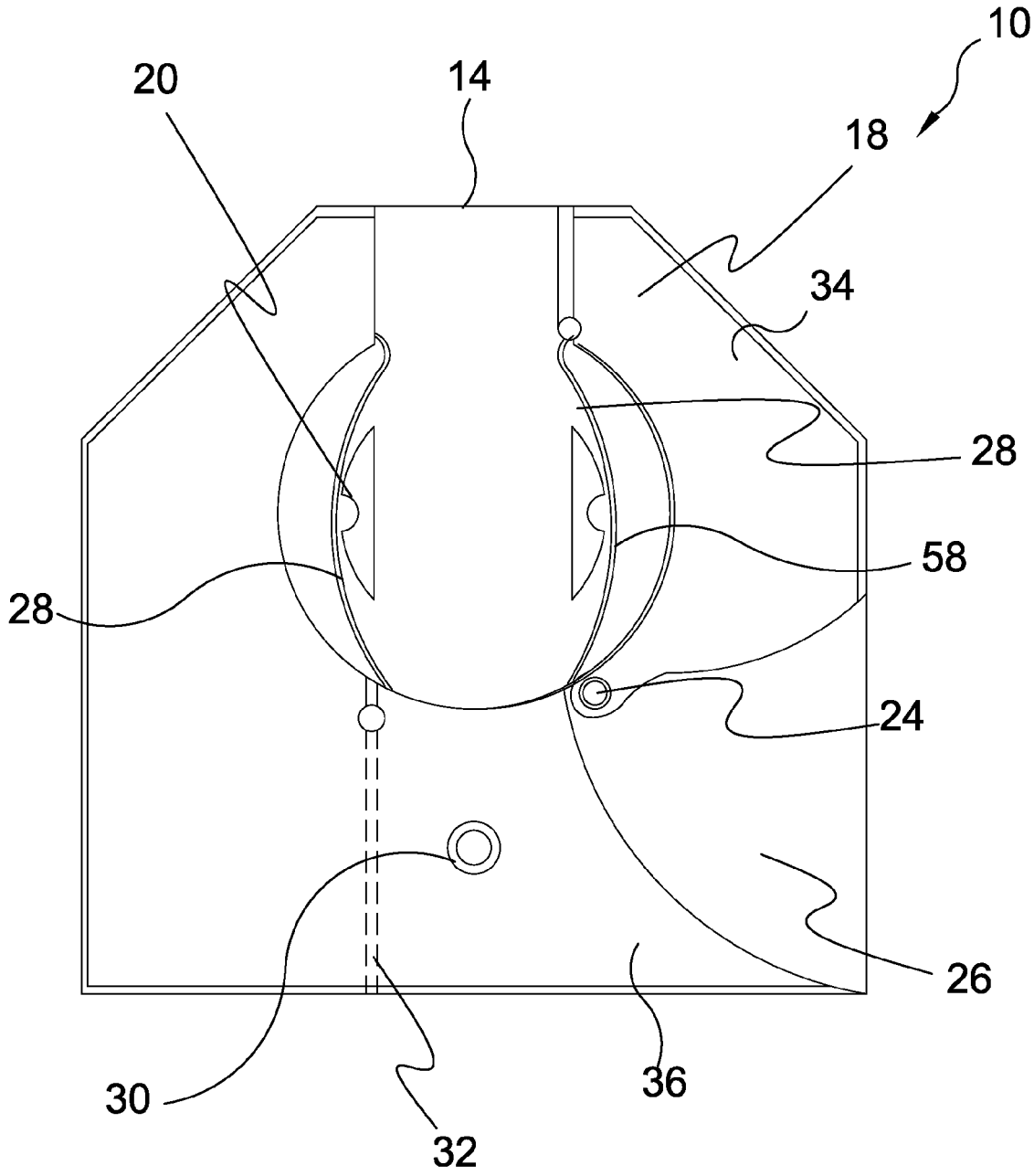
Figure 3:
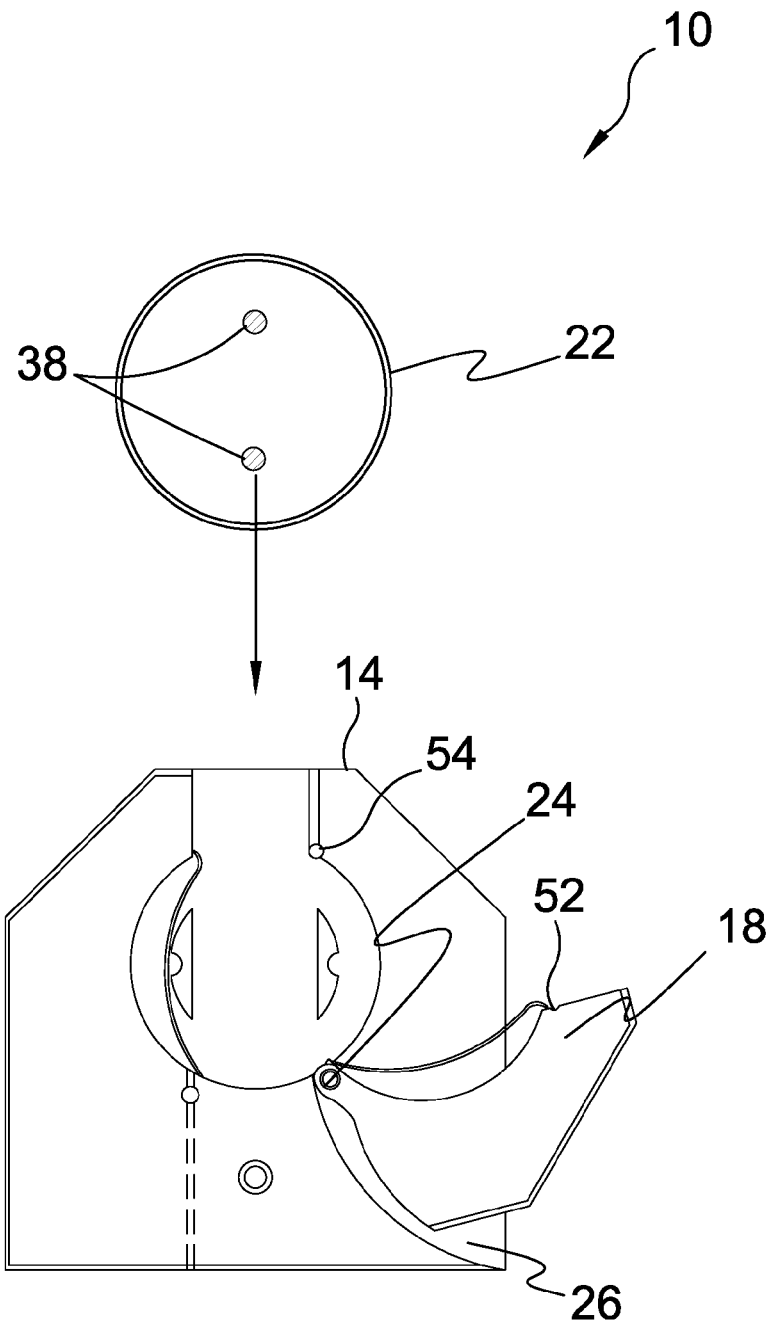
Figure 4:
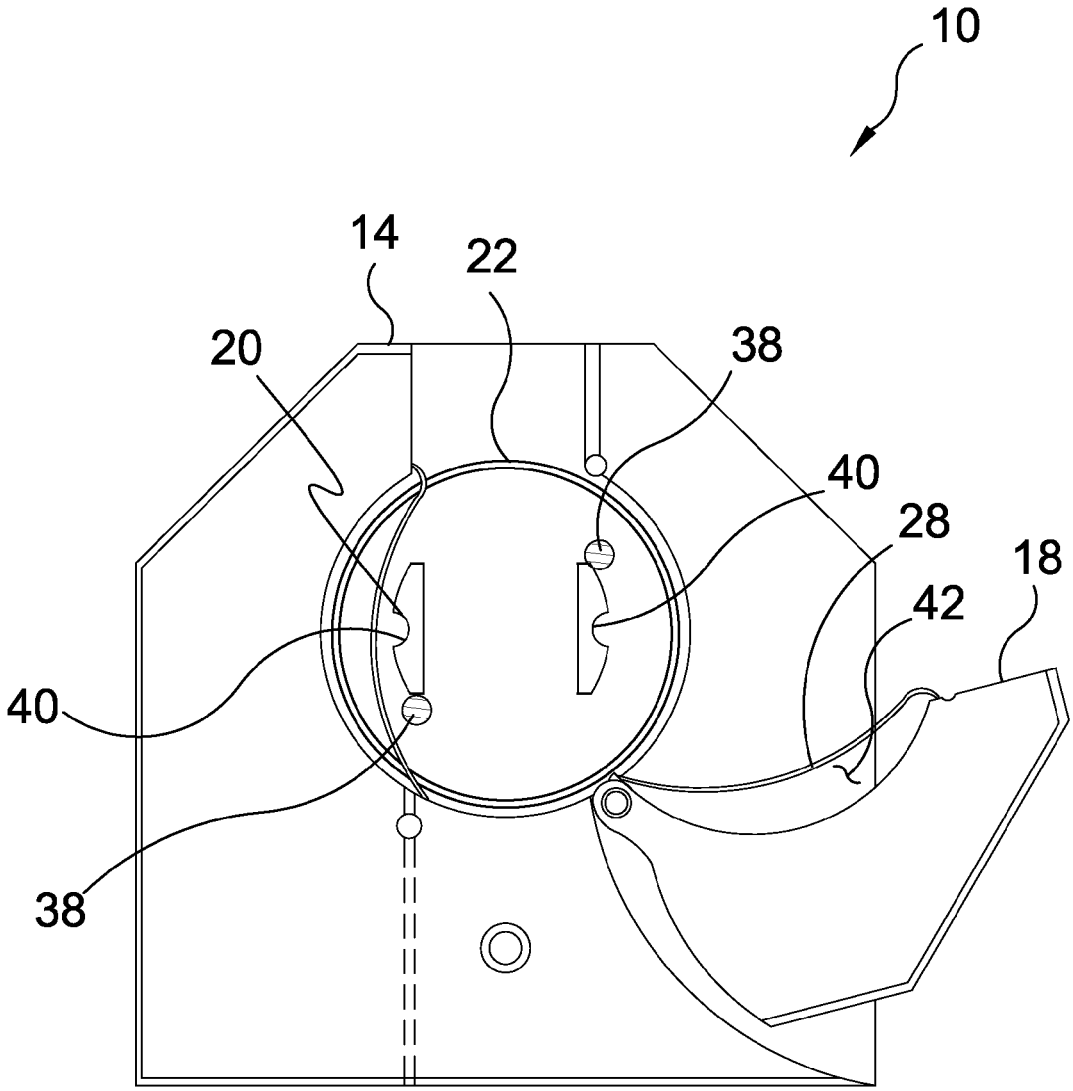
Figure 5:
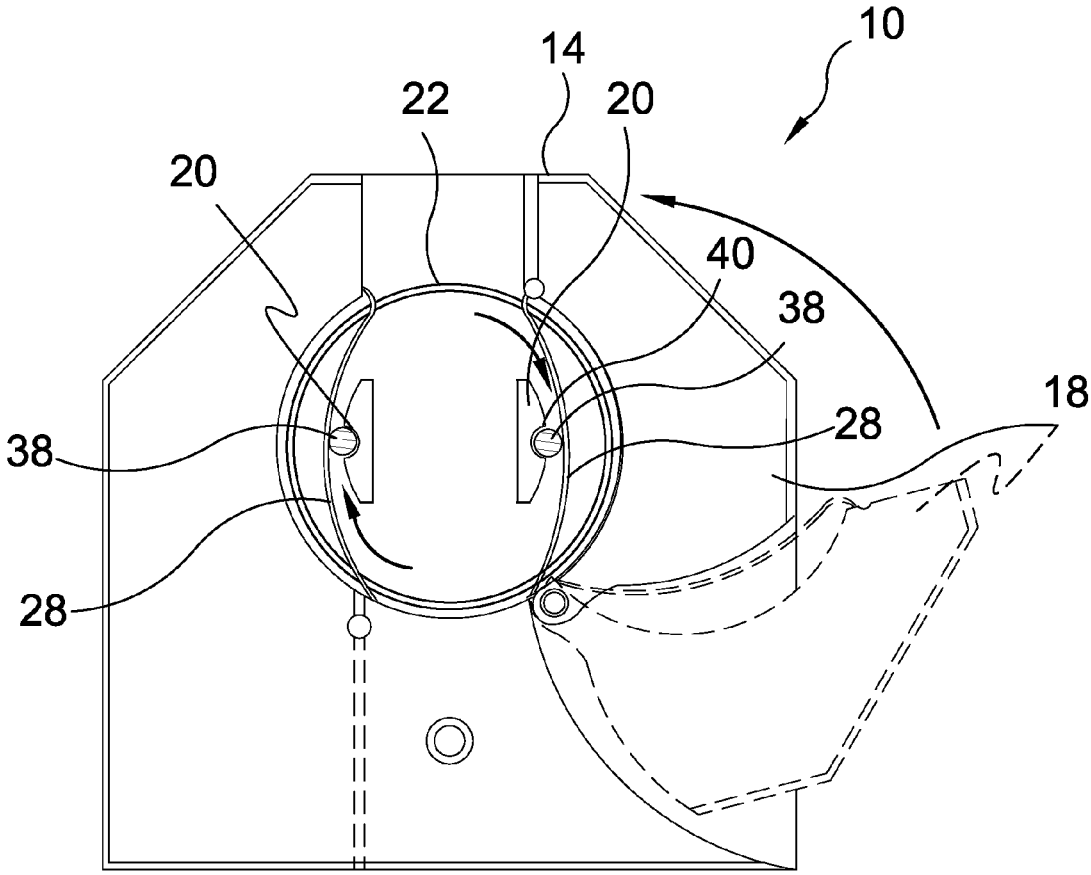
Figure 6:
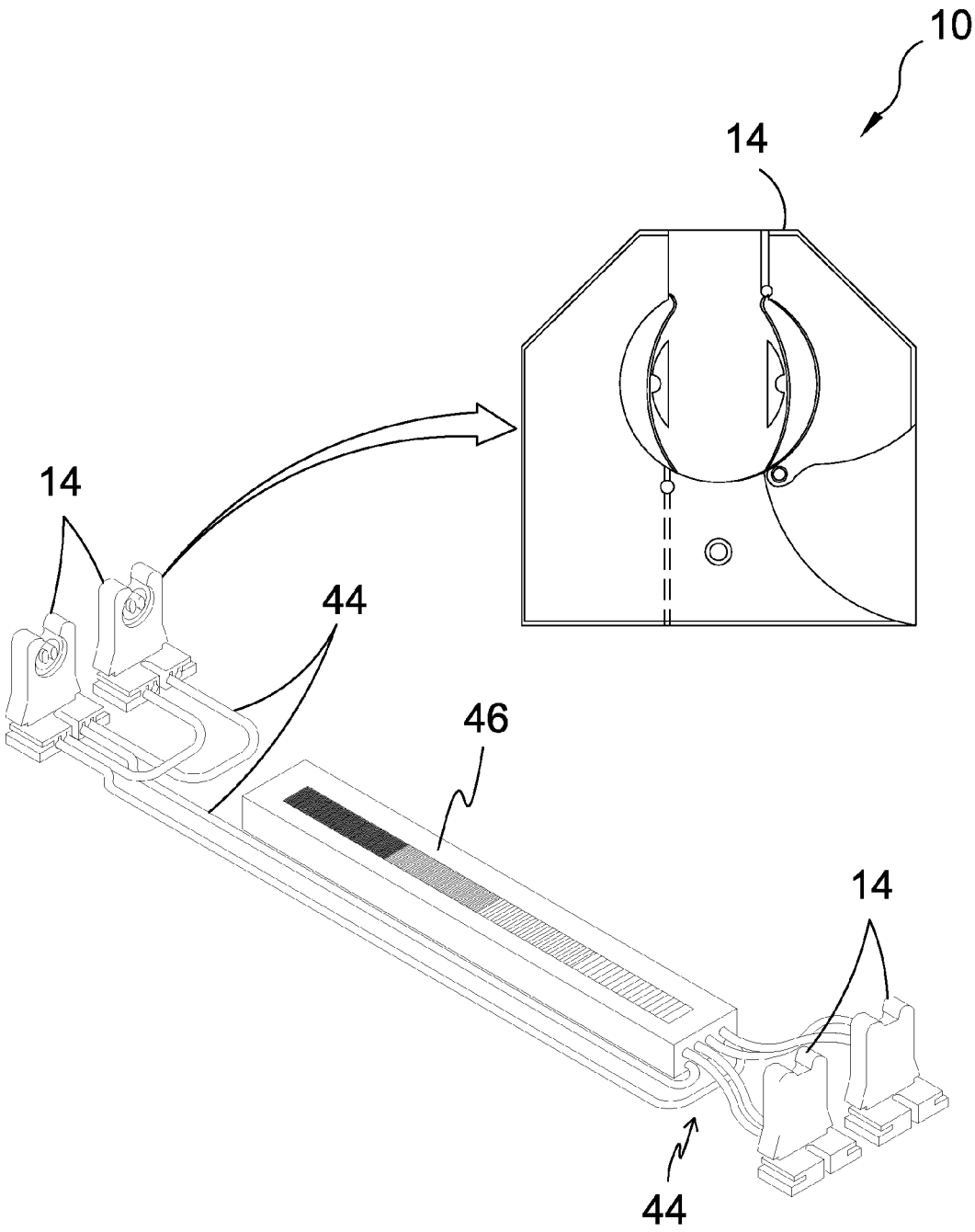
Figure 7:
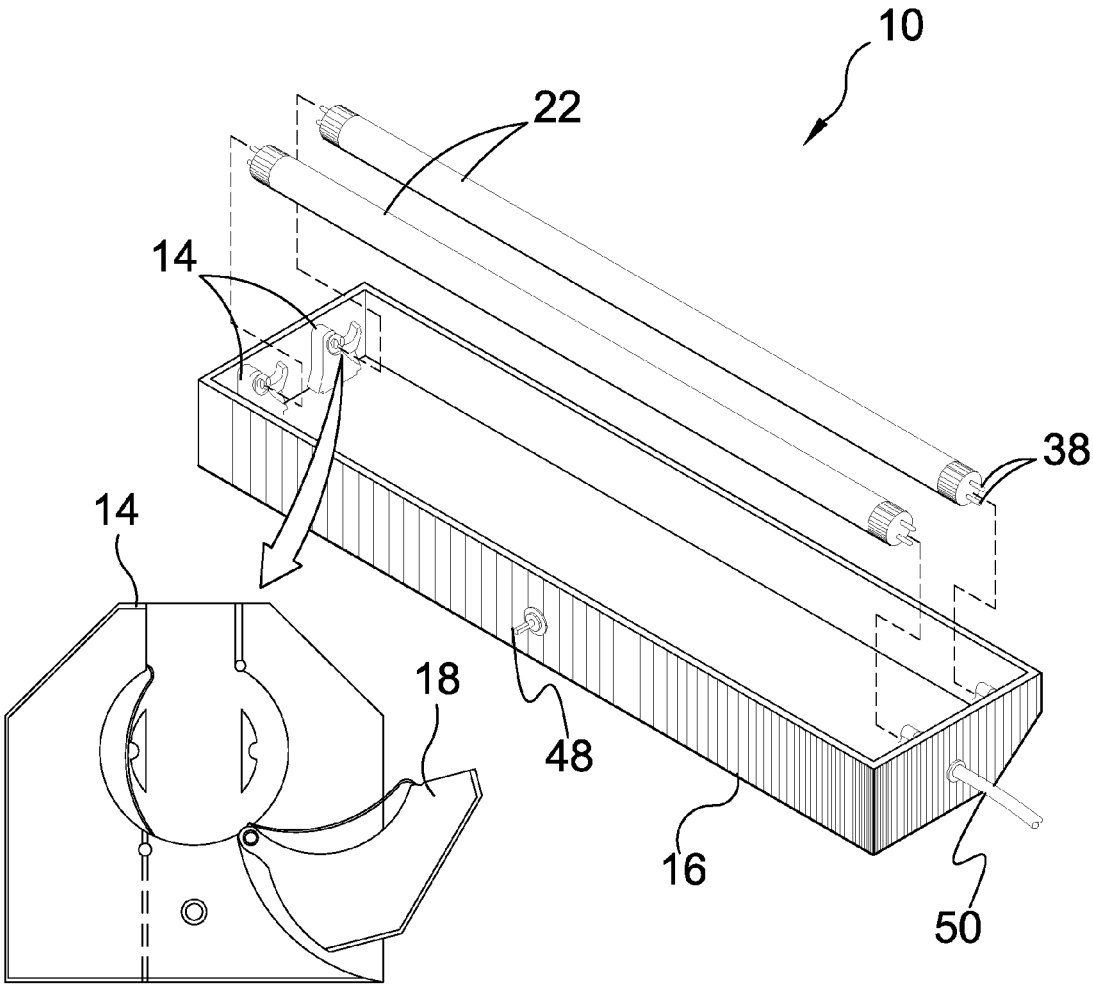
Figure 8:
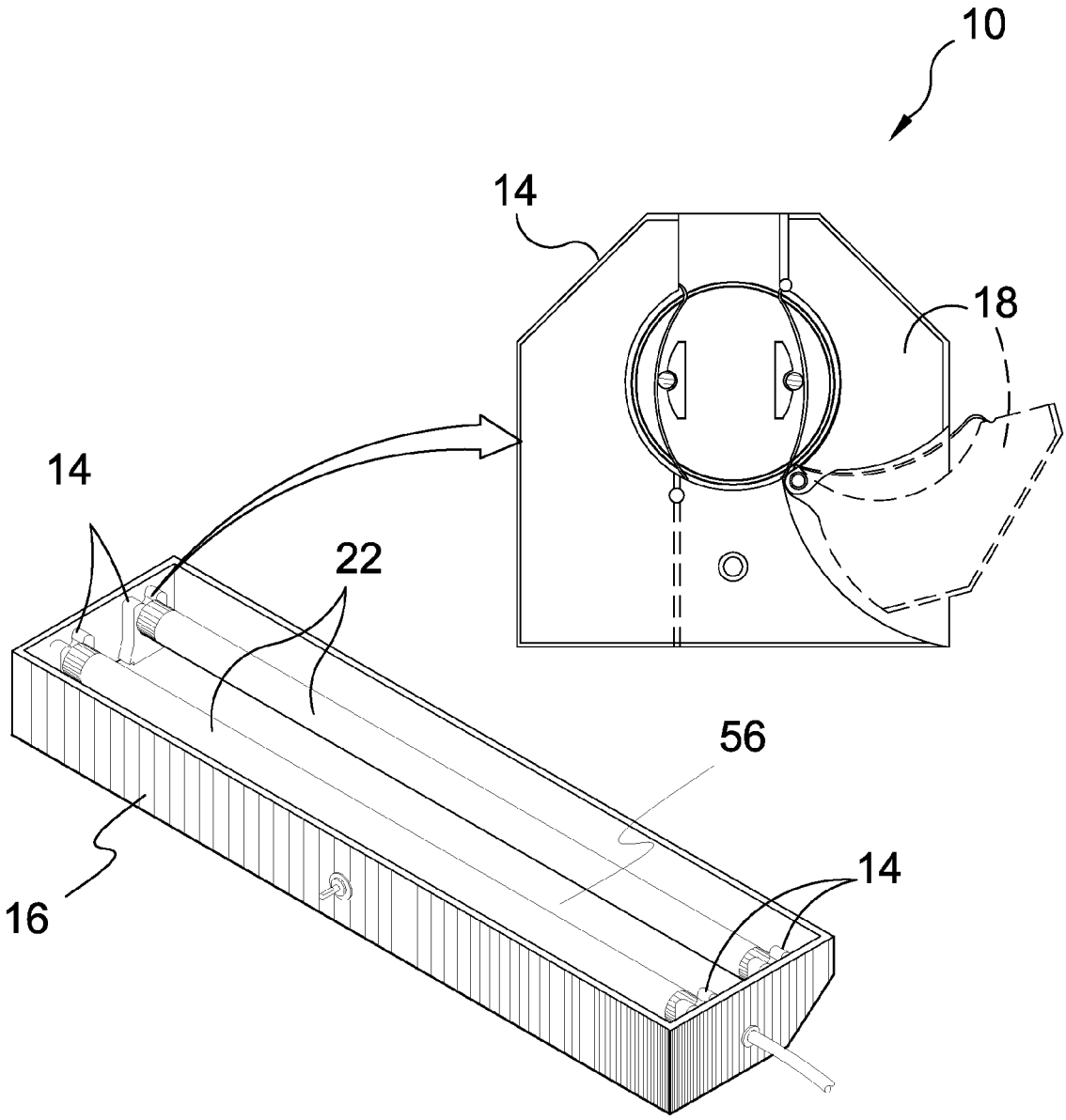

In order that the invention may be more fully understood, it will now be described, by way of example, with reference to the accompanying drawing in which:

FIG. 1 is an illustrative view of the present invention in use.
FIG. 2 is a frontal view of the present invention.
FIG. 3 is a frontal view of the present invention.
FIG. 4 is a frontal view of the present invention.
FIG. 5 is a frontal view of the present invention.
FIG. 6 is an illustrative view of the present invention in use.
FIG. 7 is an illustrative view of the present invention in use.
FIG. 8 is an illustrative view of the present invention in use.

DESCRIPTION OF THE REFERENCED NUMERALS

Turning now descriptively to the drawings, in which similar reference characters denote similar elements throughout the several views, the figures illustrate the Fluorescent Tube Lamp Socket with Pivoting Swivel Unit of the present invention. With regard to the reference numerals used, the following numbering is used throughout the various drawing figures.

10 Fluorescent Tube Lamp Socket with Pivoting Swivel Unit of the present invention
12 pivoting lock mechanism
14 tube lamp socket
16 light fixture
18 swivel unit
20 plastic knob
22 fluorescent tube lamp
24 hinge
26 recessed cut-out
28 electrical contact strip
30 mounting screw aperture
32 fixture current contact point
34 front surface of 18
36 front surface of 14
38 contact pin of 22
40 contact retaining notch of 14
42 gap
44 wiring
46 dimming ballast
48 manual on/off switch
50 power cord to power source
52 locking depression of 18
54 locking nub of 14
56 cover plate
58 concave edge of 18

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention is a light fixture 16 having fluorescent tube sockets 14 with pivoting locking mechanisms 12 having a swivel unit 18 that provides easier access of the tube lamp contact pins when introducing them to the plastic knobs 20 during installation of the fluorescent lamps 22 than that of traditional fixtures. The swivel unit 18 has an electrical contact strip 28 disposed along the concave edge 58 and pivots on a hinge 24 within a recessed cut-out 26 that the swivel unit 18 moves within.

FIG. 2 is a frontal view of the present invention 10. Shown is the socket 14 having plastic knobs 20 for holding the bulb pins in place, a mounting screw aperture 30 and a contact point 32 with the fixtures electric current. The swivel unit 18 pivots on a hinge 24 within a recessed cut-out 26 and has electrical contact strips 28 for mating with the fluorescent bulb pins. The front surface 34 of the swivel unit 18 is flush with the front surface 36 of the socket 14 due to it residing within the cut-out 26.

FIG. 3 is a frontal view of the present invention 10. Shown is the swivel unit 18 pivoted on the hinge 24 within the cut-out 26 to provide access of the contact pins 38 of the fluorescent lamp 22 into the socket 14. The swivel unit 18 secures into the closed position when the locking depression 52 is frictionally engaged with the mating locking nub 54 of the socket 14. The present invention 10 avoids the cumbersome alignment associated with conventional fluorescent lamp sockets.

FIG. 4 is a frontal view of the present invention 10. Shown is a front view of the socket 14 having a fluorescent light bulb 22 inserted therein but not yet rotated for engagement of the lamp contacts 38 with the contact retaining notches 40 of the plastic knobs 20. The contact strip 28 is flexible and has a gap 42 disposed between it and the swivel unit 18 when pivoted into the open position.

FIG. 5 is a frontal view of the present invention 10. Shown is a front view of the present invention 10 having a fluorescent light bulb 22 inserted into the fluorescent bulb socket 14 and rotated to engage the lamp contact pins 38 within the retaining notches 40 of the plastic knobs 20 and the electrical contact strips 28.

FIG. 6 is an illustrative view of the present invention 10. Shown is the electrical relationship of the lamp sockets 14 having wiring 44 communicating with the dimming ballast 46.

FIG. 7 is an illustrative view of the present invention 10. Shown are the fluorescent lamps 22 and contact pins 38 ready for insertion into the lamp sockets 14 with the swivel units 18 opened. The fixture 16 further includes an electrical wire 50 to the power source and a manual on/off switch 48.

FIG. 8 is an illustrative view of the present invention 10. Shown are the lamps 22 installed in the sockets 14 in the fixture 16 with the swivel units 18 closed and the cover plate 56 in place.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A fluorescent tube lamp fixture with a pivoting locking mechanism comprising:

a) a fluorescent tube lamp fixture having a power cord leading to an external power source;

b) at least one pair of spaced apart opposing lamp sockets;

c) a pivotable swivel unit associated with said lamp sockets that swings away therefrom to aid in installing said lamps during alignment of the contact pins therein;

d) said swivel unit is pivotally connected to said socket with a hinge connector disposed on the lower portion thereof;

e) the front surface of said socket further includes a recessed cut-out in which said swivel unit resides and travels therethrough;

f) the front surface of said swivel unit is flush with said front surface of said socket;

g) said socket further comprises a pair of arcuate, opposing, spaced apart resilient, plastic holding knobs disposed therein for guiding the rotational movement of said lamp contacts during installation; and h) said holding knobs further include a contact pin retaining notch into which said lamp contacts snap into upon alignment therewith.

2. The fluorescent tube lamp fixture with a pivoting locking mechanism recited in claim 1, wherein said swivel units are releasably secured in the close position with a locking depression disposed at a top portion of said swivel unit and a mating locking nub disposed on said socket that develop a frictional engagement connection when rotated into the closed position by the user.

3. The fluorescent tube lamp fixture with a pivoting locking mechanism recited in claim 2, wherein said swivel unit further comprises an electrical contact strip disposed along the inner concave edge thereof and the opposing side of said socket includes a second contact strip which is stationary.

4. The fluorescent tube lamp fixture with a pivoting locking mechanism recited in claim 3, wherein said swivel unit is swung open for lamp installation by releasing said locking nub from said locking depression and pivoting it downward to expose the interior portion of said socket.

5. The fluorescent tube lamp fixture with a pivoting locking mechanism recited in claim 4, wherein said lamp contacts are placed within said socket and rotated around said holding knobs and snapped into said retaining notches.

6. The fluorescent tube lamp fixture with a pivoting locking mechanism recited in claim 5, wherein the user pivots said swivel units of said sockets into the closed position and secures said locking depression with said locking knob.

7. The fluorescent tube lamp fixture with a pivoting locking mechanism recited in claim 6, whereupon closure of said swivel units provides an electrical connection between said contact strips and their respective lamp contacts.

8. The fluorescent tube lamp fixture with a pivoting locking mechanism recited in claim 7, whereupon closure of said swivel units further provides a clamping effect against the ends of said lamps to prevent the inadvertent rotation and displacement of said lamps due to vibrations and other external variables.

9. The fluorescent tube lamp fixture with a pivoting locking mechanism recited in claim 8, wherein said lamp fixture further includes a dimmer ballast in electrical communication with said power cord.

10. The fluorescent tube lamp fixture with a pivoting locking mechanism recited in claim 9, wherein power is supplied to said lamp via wiring from said dimmer ballast delivered to said contact strips of said sockets and thus energizes said lamp.

* * * * *